US008161594B2

(12) United States Patent
Policicchio et al.

(10) Patent No.: US 8,161,594 B2
(45) Date of Patent: Apr. 24, 2012

(54) PLURAL SIDED CLEANING IMPLEMENT

(75) Inventors: Nicola John Policicchio, Mason, OH (US); Andrea Pfarr Switzer, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1160 days.

(21) Appl. No.: 11/824,705

(22) Filed: Jul. 2, 2007

(65) Prior Publication Data

US 2009/0007355 A1 Jan. 8, 2009

(51) Int. Cl.
*A47L 13/12* (2006.01)

(52) U.S. Cl. ..... 15/229.4; 15/209.1; 15/226

(58) Field of Classification Search ..... 15/229.4, 15/209.1, 226, 229.13, 229.1–229.9, 228, 15/223

See application file for complete search history.

(56) References Cited

U.S. PATENT DOCUMENTS

| | | | | |
|---|---|---|---|---|
| 823,725 | A | 6/1906 | Hayden | |
| D489,537 | S * | 5/2004 | Wong et al. | D5/53 |
| 6,797,357 | B2 * | 9/2004 | Fereshtehkhou et al. | 428/141 |
| 6,813,801 | B2 | 11/2004 | Tanaka et al. | |
| D499,887 | S * | 12/2004 | Wong et al. | D5/53 |
| 6,936,330 | B2 * | 8/2005 | Fereshtehkhou et al. | 428/141 |
| 2005/0097695 | A1 | 5/2005 | Tanaka et al. | |

FOREIGN PATENT DOCUMENTS

| | | | |
|---|---|---|---|
| EP | 1 299 026 | B1 | 10/2006 |
| WO | WO2007/046251 | A1 | 4/2007 |
| WO | WO 2007/046252 | A1 | 4/2007 |
| WO | WO 2007/102254 | A1 | 9/2007 |

* cited by examiner

*Primary Examiner* — Shay Karls
(74) *Attorney, Agent, or Firm* — Larry L. Huston; Leonard W. Lewis; Steven W. Miller

(57) ABSTRACT

A plural sided duster removably attachable to a handle. The duster may have two construction portions, each with an inwardly facing surface joined to the other to form a laminate construction. The construction portions may be longitudinally offset. The arrangement allows an attachment mechanism associated with the inwardly facing surface to be visible to the user, so the handle may be easily and removably attached to the duster at the attachment mechanism.

19 Claims, 2 Drawing Sheets

PLURAL SIDED CLEANING IMPLEMENT

BACKGROUND OF THE INVENTION

Various cleaning articles have been created for dusting and light cleaning. For example, cloth rags and paper towels used dry or wetted with polishing and cleaning compositions have been used on relatively flat surfaces. But, rags and paper towels are problematic for reasons such as hygiene (the user's hand may touch chemicals, dirt or the surface during cleaning), reach (it may be difficult to insert the user's hand with the rag or paper towel into hard-to-reach places) and inconvenience (cleaning between closely-spaced articles typically requires moving the articles).

To overcome the problems associated with using rags and paper towels, various dust gathering devices having feathers, lamb's wool, and synthetic fibers brushes have been utilized for more than a century as illustrated by U.S. Pat. No. 823,725 issued in 1906 to Hayden. Such dust gathering devices can be expensive to manufacture, and as such are designed to be cleaned and reused. One problem associated with a reusable dust gathering device is that such a dust gathering devices may not hold or trap dust very well. As such, soils trapped by dust gathering devices are prone to redeposit dust during use, which can require the cleaning process to be repeated.

Furthermore, soiled reusable devices are typically cleaned via shaking or through other mechanical agitation. This process is not entirely satisfactory as it entails an extra step during (and often interrupting) or following the cleaning process. Furthermore, the attempted restoration of the device may not be successful, allowing further redeposit of the dust collected thereon.

To address the problems experienced with reusable dust gathering devices, disposable dust gathering devices have been developed which have limited re-usability. These disposable dust gathering devices may include brush portions made of synthetic fiber bundles attached to a non-woven sheet (nonwoven). Such devices may be made, for example, according to U.S. Pat. No. 6,813,801 B2, US Publication 2005/0097695 A1 and/or EP 1,299,026 B1.

These references disclose disposable cleaning articles attachable to and removable from a reusable handle. The articles may be elongate along a longitudinal axis, flat, and/or may be "fluffed" to increase their thickness. Such articles may be sided, having a preferential cleaning side, which is the side typically used for contacting a target surface to remove dust therefrom. Opposite the cleaning side may be a second side, usable as an attachment side. The attachment side is usable for attaching the duster to a handle.

The handle may have a grip which is held by the user during cleaning and one or more means for removably attaching the handle to the disposable duster. Common means for removably attaching the handle to the duster include one or more elongate tines. The one or more tines may be inserted into one or more complementary sleeves disposed on the duster. A common geometry comprises two longitudinally parallel elongate times on the handle which are inserted into complementary longitudinally parallel elongate sleeves disposed on the attachment side of the duster.

However, a duster having a single preferential cleaning side may require two passes to clean a crevice or opposed surfaces of closely spaced articles—a first pass to clean one side of the crevice/one surface and a second pass to clean the opposite side/surface. This increases the time of the cleaning process—assuming the user even remembers to reverse the duster for the second pass.

To overcome this problem, dusters having plural sides, up to a nominally 360 degrees usable circumference, have been proposed. However, such dusters can be complex, and thus expensive, to manufacture.

To overcome the manufacturing complexity, and thereby reduce cost, one attempt may be to manufacture a plural sided duster. Such a duster may be manufactured by placing two or more dusters in back-to-back relationship with the attachment sides facing the center and the preferential cleaning surfaces facing outwardly. This arrangement provides the simplicity of being able to use two (or more) identical dusters to make a single cleaning device.

However, if the second sides are placed inwardly, i.e. facing towards the center of the device, it may be difficult for the user to utilize (or even directly touch) the attachment system for attaching the handle. For example, if the common dual sleeve arrangement is utilized, the sleeves may not even be visible to the user. This makes it difficult for the user to properly align the handle for attachment to the duster.

While attempts to improve the cleaning characteristics of dust gathering devices have been made, the search still continues to reduce the problems and inefficiencies of dusters, particularly as related to a plural sided duster for cleaning a target surface.

SUMMARY OF THE INVENTION

The invention comprises a duster for removing debris from a surface. The duster comprising at least two construction portions joined in facing relationship, each construction portion having an outwardly facing surface for contacting a target surface, and an attachment system for removably attaching the duster to a handle. The attachment system has a first portion disposed external to the layers so that said attachment system portion is accessible by a handle, and a second portion disposed between said layers.

DETAILED DESCRIPTION OF THE INVENTION

As used herein "limited re-usability" means that the duster 10 may be used for one job (about 6-12 square meters of surface), and immediately discarded or restored and re-used for about 1 to about 5 more jobs, then discarded. Traditional dusters including feather dusters, cloths, string mops, strips mops and the like, are not disposable for purposes of this invention.

Hydrophilic refers to fibers or other materials having a high affinity for water and/or aqueous solutions. Hydrophilic fibers include but are not limited to woody fibers such as cellulose and non-woody fibers such as cotton, hemp, jute, abaca, kenaf, sabai grass, flax, esparto grass, straw, bagasse, milkweed floss fibers and pineapple leaf fibers. Hydrophilic fibers can also include chemically treated fibers, such as rayon, viscose, lyocell, acetate, triacetate and the like. As used herein hydrophilic non-woven layer(s) or hydrophilic non-woven(s) refers to a layer or layers comprising hydrophilic non-woven fibers or sheet material treated to be hydrophyllic.

Hydrophobic, refers to fibers or other materials having a low affinity for water and aqueous solutions, and which may be synthetic and/or thermoplastic. Fibers/materials which are naturally hydrophobic include polymers derived from ethylene, propylene, styrene, amides and esters, either as homologous polymers random copolymers or block copolymers.

The z-direction of the duster 10 is the direction perpendicular to the non-woven layer closest to the handle 50; the x-y plane of the duster 10 is defined as the plane defined by the non-woven layer closest to the handle 50. The length of the duster 10, sleeve 20, etc. is taken in the longitudinal direction. The width of the duster 10 corresponds to the direction perpendicular to the length and disposed within the plane of the attachment layers. The thickness is defined as the dimension in the z-direction. The longitudinal direction is the major direction of the duster 10, handle 50 or a component thereof. As used herein, longitudinally offset refers to a disposition of two or more components, or points on one or more components, which do not lie on a common line emanating from the longitudinal axis L-L and extending perpendicular thereto in the plane containing such points or components.

Figure 1:
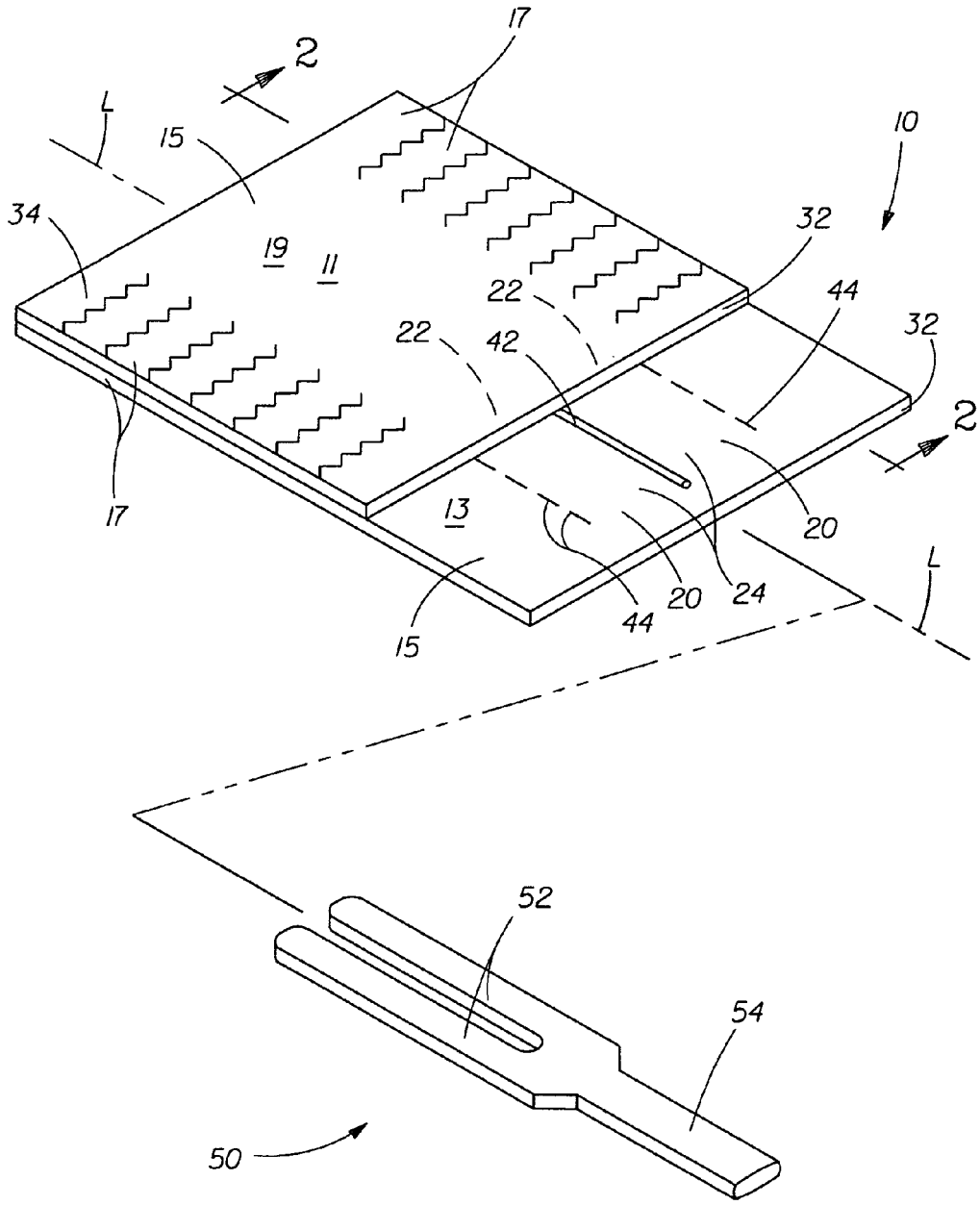
FIG. 1 is a perspective view of a duster and a removably attachable handle.

Referring to FIG. 1, the duster 10 may be generally elongate, having a longitudinal axis L-L as shown, although other shapes are feasible. The duster 10 may be removably attached to a handle 50, as shown.

The duster 10 may comprise one or more construction portions 15. The construction portions 15 may be laminated together. Each construction portion 15 may have a first outwardly facing preferential cleaning side 19 and a second inwardly facing attachment side opposed thereto. An individual construction portion 15 may be usable as a sided duster 10, as known in the art. Sided dusters 10 may be utilized in back-to-back relationship as a way of forming the duster 10 of the present invention.

Figure 2:
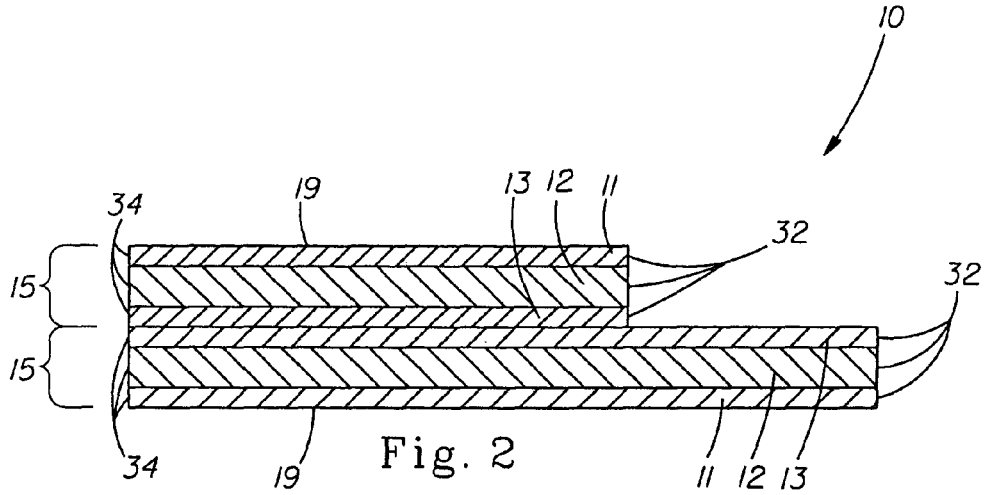
FIG. 2 is a schematic exploded vertical sectional view taken along line 2-2 of FIG. 1, the separation between adjacent strips being omitted for clarity.
Figure 3:
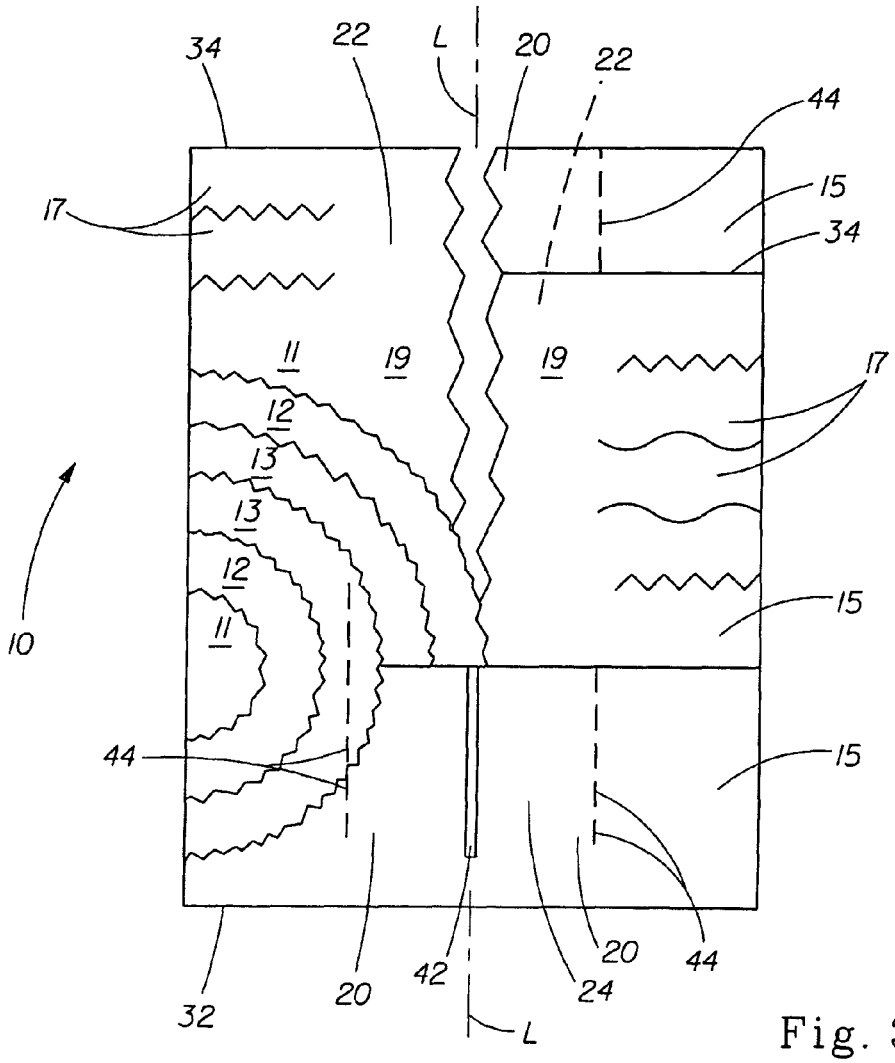
FIG. 3 is a broken top plan view of a duster shown partially in cutaway, the left side being the duster of FIG. 1, the right side being an alternative embodiment having two construction portions of unequal length and without a coterminous longitudinal end.

Referring to FIGS. 2-3, the duster 10 may comprise one to eight or more layers, with three to six layers having been found suitable. For ease of manufacture, the duster 10 may comprise first and second construction portions 15 joined together in face-to-face relationship to form a laminate. The first and second construction portions 15 may be generally similar or identical, and joined back to back so that each construction portion 15 has an inwardly facing surface interior to the duster 10 and joined to the and/or contacting the inwardly facing surface of the other construction portion 15. Likewise, each construction portion 15 may have an outwardly facing surface 19 suitable for cleaning. The outwardly facing surfaces 19 of each construction portion 15 may be generally oriented 180° apart. In alternative embodiments, the duster 10 may comprise three construction portions 15, mutually disposed 120° apart; four construction portions 15 mutually disposed 90° apart, may be unequally angularly disposed, etc. The construction portions 15 may be mutually identical, providing for standardization and convenience in manufacture. Alternatively, plural construction portions 15 may be different and customized to the geometry of the handle 50.

Referring to FIG. 2, each construction portion 15 may comprise an optional first layer 11 for preferentially contacting the target surface to be cleaned. The target surface may be rigid, such as a shelf or countertop, or may be soft, such as cloth or leather.

The first layer 11 may comprise a nonwoven sheet. Adjacent the first layer 11 may be a compressible and/or deformable second layer 12. The second layer 12 may comprise tow fibers. The second layer 12 may be suitable for contacting the target surface in case the optional first layer 11 is omitted or becomes disturbed. Adjacent the second layer 12 may be a third layer 13. The third layer 13 may provide, have disposed thereon or be juxtaposed with an attachment system. The third layer 13 may comprise a nonwoven sheet.

The three, or more layers 11, 12, 13, may be joined together to form a unitary construction portion 15. Joining may be accomplished using any means known in the art such as adhesive bonding, heat sealing, autogenious bonding, etc. The joining may be done in a pattern which provides an attachment system for removably attaching the handle 50.

Referring to FIG. 1, the handle 50 may be elongate, and have a handle attachment. The handle attachment may be removably attached to and attachably removed from the duster 10 attachment system. The handle attachment and duster 10 attachment system are considered complementary if they allow for such removable attachment without destruction or undue distortion of either such component, it being recognized the handle 50 is intended for multiple uses and the duster 10 intended for a single cleaning job.

An attachment system may provide for removable attachment of the duster 10 to any suitable handle 50. The duster 10 attachment system and complementary handle attachment may comprise adhesive joining, cohesive joining, mechanical engagement, etc. The attachment system may be internal to the construction portion 15, or disposed on any of the layers utilized to form the construction portion 15. For example, the attachment system may be disposed on the third layer 13.

Referring to FIGS. 2-3 and examining the components of the duster 10 in more detail, the duster 10 may comprise at least one first layer 11 of hydrophilic non-woven fibers. The first layer 11 may be hydroformed and/or a textured nonwoven. Suitable nonwovens may be made according to commonly assigned U.S. Pat. Nos. 6,797,357; 6,936,330, D489, 537 and/or D499,887.

The first layer 11 may have at least one free end movable independently of the balance of that layer 11. In one embodiment, one or more free ends may be achieved by partially bonding at least one layer of non-woven fibers to the second layer 12. In an alternative embodiment, an increased amount of free ends may be created by cutting the layer comprising hydrophilic non-woven fibers into a plurality of strips 17.

The strips 17 may be skewed relative to the longitudinal direction, and may be orthogonal thereto and/or disposed in the XY plane. The strips 17 are capable of moving mutually independently, allowing the duster 10 to get into relatively small spaces. By having at least one layer with moving free ends, the surface area of the duster 10 may be increased, providing better cleaning. The strips 17 may be of equivalent length and width and have sides defined by like serrations, as illustrated on the left side of FIG. 3 or of unequal length and width with differing sides, as illustrated on the right-hand side of FIG. 3

There is no limitation to the number of first layers 11, hydrophilic or hydrophobic, usable with the present invention. In one embodiment about 2 to about 20 layers of a hydrophilic non-woven sheet, each ranging from about 5 to about 500 g/m$^2$, may be utilized in the first layer 11. Any of the first, second, and third layers 11, 12 and 13 may be coasted with wax and/or oils to increase retention of absorbed soils.

The optional second layer 12 of duster 10 may comprise bundle fiber layers, such as tow fibers. The two fibers may be synthetic. The second layer 12 may be juxtaposed with the first and third layers 11, 13 in any manner. As used herein "bundle fibers" and/or "tow" mean fibers comprising synthetic polymers including polyester, polypropylene, polyethylene and cellulose materials including cellulose acetate and mixtures thereof manufactured wherein the individual fibers are relatively long strands manufactured in bundles. The bundle fibers may be defined as any fibers having distinct start and end points and at least about 1 cm in length.

The duster 10 of the present invention may optionally comprise an absorbent core (not shown) having absorbency greater than the absorbency of the hydrophilic non-wovens. The core may be juxtaposed with the second layer 12 and disposed on either side thereof. The absorbent core may be air-laid and/or may contain absorbent gelling materials. The absorbent core may provide stiffness to the duster 10. The absorbent core(s) may be disposed adjacent the handle 50, or be juxtaposed with the first layer 11. The duster 10 may optionally comprise a dedicated stiffening layer which allows increased pressure to be applied to the target surface. Non-limiting examples of suitable stiffening materials include cardboard, PVA foams, polyethylene, polypropylene and polyester films and mixtures thereof, rigid foams, rubber, wood, etc.

As used herein, an absorbent core may comprise a hydrophilic non-woven material with a caliper of at least about 0.4 mm thick under a 70 ksm confining pressure and which may additionally have an absorbency of deionized water of at least about 7 grams per gram of substrate. A core may have a basis weight of at least about 70 $g/m^2$ or at least about 75 $g/m^2$ and less than about to about 500 $g/m^2$ or less than about 300 $g/m^2$ with a density of less than about 0.15, or less than about 0.10 $g/cm^3$, to maximize fluid capacity and bulk. The absorbent core may act as a reservoir for retention of cleaning fluids.

The third layer 13 may comprise any sheet which provides a chassis for the remaining layers 11, 12. The first layer 11 may be a film, such as a polyolefinic film, a nonwoven or other suitable flexible material which is generally planar and which is either suitable for cleaning a surface or suitable for attaching other materials which can be used for cleaning a surface.

A third layer 13 comprising a synthetic fiber nonwoven has been found suitable. The synthetic fiber nonwovens may be meltable, allowing for binding of other layers without the use of adhesives or additional materials. Two or more plies of nonwoven, film, etc. may be joined together to form a laminate third layer 13. The two plies may be identical or different in size, materials, etc., as desired.

Two or more plies may be joined together to create one or more third layers 13 by thermal bonding, autogenious bonding, adhesive or other means known in the art. The bonding joining the two plies may be provided in a pattern which provides a sleeve 20 complementary to and able to receive the tines 52 of the handle 50. The bonding may be provided in a pattern which is generally longitudinally oriented, so that the tines 52 may be inserted into the pocket or sleeve 20 created between adjacent bonds. The non-limiting, exemplary bond pattern, illustrated in FIG. 3 has a central spine 42 illustrated as continuous, although a discontinuous central spine 42 bond pattern may also be employed.

The layers 11, 12, 13 may be joined together using a predetermined bond pattern. One suitable bond pattern comprises a central longitudinal bond which forms a spine 42 in the construction portion 15 of the duster 10 and joins the layers together. This spine 42 may be a continuous bond. Secondary bonds 44 may be disposed outboard of the spine 42 and may also be longitudinally oriented. The secondary bonds 44 may be disposed symmetrically opposite the spine 42 to define a longitudinally oriented sleeve 20 therebetween. The secondary bonds 44 may be discontinuous.

Outside of the central spine 42 bond pattern may be other patterns of continuous or discontinuous bonds also generally longitudinally oriented. The space between the central spine 42 bond and the outboard bonds 44 disposed immediately laterally outboard of the central spine 42 may create a pocket or sleeve 20 for receiving a tine 52 of the handle 50. If the outboard bonds 44 are discontinuous, such bonds may be provided in one or more outboard lines generally oriented in the longitudinal direction and, in a degenerate case parallel to the longitudinal axis L-L. If desired, two outboard lines may be utilized. The two first lines may be parallel to and generally symmetrically opposite the central spine 42.

If desired, additional bonds may be juxtaposed with the outboard line or lines of bonds. Such additional bonds may be provided in one or more tertiary lines, and be generally oriented in the longitudinal direction and, again, in a degenerate case parallel to the longitudinal axis L-L. Both of the central spine 42 of bonds and second line 44 of bonds may be continuous or discrete. It has been found that if both the second lines 44 of bonds are discontinuous, the duster 10 may be more easily formed into a thicker configuration, which is often desirable for cleaning.

The first line of bonds 42 and second line 44 of bonds may be of any suitable shape, if discontinuous. The first line of bonds and second line 44 of bonds may have individual bonds which are longitudinally offset from one another to increase the tendency of the duster 10 to assume a relatively thicker geometry. Furthermore, the bonds 42, 44 may be used to join the first, second and third layers 11, 12, 13 into a unitary construction portion 15. Likewise, a single set of bonds may be used to join the layers of a single construction portion 15 and plural construction portions 15 to form a unitary duster 10.

One construction portion 15 may be disposed on the other so that each construction portion 15 has a first end 32 and second end 34 corresponding to a respective first end 32 and respective second end 34 of the other construction portion 15. The first and second ends 32, 34 may be spaced apart in the longitudinal direction.

The sleeves 20 may thus be equally sized and symmetrically disposed with respect to the longitudinal centerline of the duster 10. This arrangement allows plural tines 52 of the handle 50 to be identical, providing for simplicity of manufacture of the handle 50. Alternatively, the sleeves 20 may be of different sizes or have different positions on the construction portions 15. This arrangement provides the benefit that the handle 50 and duster 10, in combination, may only be assembled in a proper, dedicated manner.

Likewise, the at least one sleeve 20 complementary to receive a tine 52 may be generally straight, of constant or variable cross section (such as tapered), may be made of elastic or inelastic materials or have elastic strands added thereto to engage the tines, etc. The number of sleeves 20 may be less than, equal to or greater than the number of complementary tines.

Referring to FIG. 1 and examining the handle 50 in more detail, the handle 50 may comprise one or more handle attachments for attachment to the duster 50 attachment mechanism and a grip 54, which is held by the user. The handle 50 may facilitate reach and maneuverability, provide pressure to the target surface to improve cleaning, and separation between the target surface and the user's hands. Any handle 50 removably attachable to the duster 10 is contemplated, such as illustrated in WO 02/34101 A1 filed Oct. 25, 2001. The handle 50 may be removably attached to the duster 10 directly or may be indirectly connected through another member using any operative connection, including mechanical and chemical means. By way of non-limiting example, hook and loop fasteners, adhesive, cohesive attachment, or mechanical engagement may be used to removably attach the handle 50 and duster 10. If mechanical engagement is selected, the duster 10 may have a sleeve 20 complementary to and for receiving one or more tines 52 of the duster 10. The tines 52 of the handle 50 may be generally flat and planar, of constant or variable cross section, may be curvilinear in the plane of the tines 52 or the plane perpendicular thereto, may be of the same or different size and geometry.

The tines 52 may be cantilevered from the grip 54. The tines 52 and grip 54 may be unitary/integral or may comprise two or more parts joinable together. The tines 52 may be generally parallel or skewed relative to one another and maybe generally oriented parallel the longitudinal axis L-L. While two tines 52 are shown, the handle 50 may comprise a single tine 52, or two or more tines. Any configuration which allows the tines 52 to engage and hold the duster 10, as described below is suitable. The grip 54 may also be generally longitudinally oriented, parallel to and in line with or offset from the one or more tines. The handle 50 may be telescoping, or otherwise extendable/retractable and/or articulating.

Referring back to FIGS. 2-3, the sleeve 20, or other attachment device, may have a first portion 22 disposed between the construction portions 15, and more particularly between the outwardly facing layers of the construction portions 15. This provides the benefit that it is not necessary for the first portion 22 of the sleeve 20 to be aesthetically pleasing and, further the first portion 22 is protected from being disturbed during use or even during packaging and shipment.

The sleeve 20, or other attachment device, may further have a second portion 24 disposed external to the construction portions 15. This provides the benefit that the second portion 24 is visible at the point of use and easily accessible to the handle 50, and more particularly to the tines 52 of a handle 50 having a longitudinally oriented attachment. The second portion 24 may be proximal to any attachment of the handle 50, and may be the portion of the sleeve 20 initially contacted by the handle 50 when being attached to the duster 10. The portion 22 of the sleeve 20 disposed between the construction portions 15 will generally be engaged by the tines 52 after the proximal end of the sleeve 20 is engaged.

The second, or external portion 24 of the at least one sleeve 20 may be juxtaposed with or disposed on one or more third layers 13 of either or both construction portions 15. For example, the sleeve 20 may be formed as an opening between two third layers 13, otherwise joined together. Alternatively, the sleeve 20 may be disposed on a single third layer 13. The sleeve 20 may have a perimeter defined by bonds 42, 44. The bonds 42, 44 may comprise heat seals, adhesive, elastic or inelastic strands, etc. The bonds 42, 44 may be continuous or discontinuous, as desired.

The construction portions 15 may be identical and assembled in a longitudinally offset pattern. This arrangement allows for a portion of the third layer 13, and like a portion 24 of the sleeve 20 disposed thereon, to be exposed. The exposed portion 24 of the sleeve 20 and third layer 13 may then be visible at the point of use, and accessible to the handle 50. Additionally, the portion of the duster 10 distal to the tines 52, when engaged, may be more flexible, since it has only a single construction portion 15 contributing to the stiffness. This arrangement provides the benefit that the tip of the duster 10 may reach into crevices, etc. of unusual or particularly narrow configurations.

The construction portions 15 may be of unequal length in the longitudinal direction and of equal or unequal width or thickness. If so, the shorter construction portion 15 may be disposed on or with respect to the longer construction portion 15 so that the respective first ends 32 are longitudinally offset. This arrangement exposes the first end 32 of the sleeve 20, allowing it to be visible to and accessed by the user without further manipulation.

Referring to the left-hand portion of FIG. 3, the respective second ends 34 of construction portions 15 having different lengths may be disposed at a common point and thereby have a Referring to the left-hand portion of FIG. 3, the respective second ends 34 of construction portions 15 having different lengths may be disposed at a common point and thereby have a coterminous longitudinal end 34. This arrangement provides the benefit that a greater portion of the sleeve 20 may be exposed, allowing it to be easily accessed at the point of use.

The sleeve 20 may have an exposed second portion 24 with a longitudinal dimension of at least 5 mm. This length is sufficient for most users to manipulate and attach the handle 50 thereto.

Alternatively, referring to the right-hand portion of FIG. 3, the respective second ends 34 of construction portions 15 having different lengths may be disposed so that both the first and second ends 32, 34 of the shorter construction portion 15 are disposed longitudinally inward of the respective first and second ends 32, 24 of the longer construction portion 15. This arrangement may provide a geometry with two exposed portions of the sleeve 20. This provides the benefit that the tines 52 of the handle 50 may be inserted into the sleeve 20 from either longitudinal direction.

If desired, the sleeve 20 or other attachment device of the duster 10 may be provided with one or more indicia to assist the user in finding the sleeve 20, or other attachment device and removably attaching it to the tine 52 or other attachment system of the handle 50. For example, the sleeve 20 may have a color which contrasts with the color of the balance of the duster 10. Additionally or alternatively, an arrow or other visual signal may be printed or otherwise disposed on the duster 10. The arrow or other visual signal may be positioned to designate the longitudinal direction and/or proximal end of the sleeve 20.

If desired, such indicia may be provided by the pattern of bonds 42, 44 or the shape of individual bonds 42, 44. For example, if the third layer 13 is a relatively light color and the second layer below 12 is a darker color, the bonds 42, 44 joining these layers 13, 12 will appear darker than exposed layer 13. This darker color provides a color contrast which may form the indicia to assist the user in attaching/removing the handle 50 and duster 20.

If desired, the duster 10 may optionally be used with a cleaning solution or other solution usable for other purposes such as treating the surface for appearance or disinfectant, etc. The cleaning solution may be pre-applied to the duster 10, creating a pre-moistened duster 10 or may be contained within a separate reservoir for dosing onto the duster 10 and/or target surface. The cleaning solution may comprise a majority water, or at least about 60%, 70%, 80% or 90% water. A cleaning solution usable with the present invention may comprise at least about 0.5, 2, 5 or 30% or at least about 50% aqueous solvents and water or mixtures thereof by weight. The duster 10 of the present invention may be used with non-aqueous solutions as well.

What is claimed is:

1. A duster for removing debris from a surface and having a longitudinal axis, said duster comprising:

at least first and second construction portions joined in facing relationship, each said construction portion comprising plural layers and having an outwardly facing surface for contacting a target surface, each of said plural layers of each said construction portion comprising a nonwoven sheet and a layer of tow fibers; whereby a nonwoven sheet of said first construction portion is in contacting relationship with the nonwoven sheet of said second construction portion and said tow layer of said first construction portion and said tow layer of said second construction portion face outwardly from said first and second nonwoven sheets, said first construction portion and said second construction portion being of substantially identical component layers; and an attachment system for removably attaching said duster to a handle, said attachment system having a first portion disposed external to said first and second nonwoven sheets so that said first portion of said attachment system is accessible to a handle, and a second portion disposed between said outwardly facing layers of said construction portions, one said construction portion being longitudinally offset relative to the other said construction portion.

2. A duster according to claim 1 being elongate along said longitudinal axis, said attachment system also being elongate along said longitudinal axis.

3. A duster according to claim 2 wherein said attachment system comprises an elongate sleeve for receiving a tine from a handle, said elongate sleeve having a proximal end disposed externally to at least one of said layers and a distal end longitudinally remote therefrom, said distal end being disposed between said layers.

4. A duster according to claim 3 having a longitudinal centerline, said duster comprising two elongate sleeves, said sleeves disposed symmetrically opposite one other with respect to said longitudinal centerline.

5. A duster according to claim 4 comprising at least two identical construction portions joined in face-to-face relationship to form a laminate.

6. duster according to claim 4 comprising at least two construction portions joined in a face-to-face relationship to form a laminate, said one said construction portion having a greater longitudinal dimension than the other said construction portion.

7. A duster according to claim 6 wherein said construction portions define a proximal end having an exposed attachment system and a distal end longitudinally remote therefrom, each said construction portion terminating at a common distal end.

8. A duster for removing debris from a surface, said duster comprising:

two matched construction portions joined in facing relationship, each said construction portion being elongate along a longitudinal axis and having an outwardly facing layer for contacting a target surface, each said construction portion being flexible, for compliance with the target surface; each said construction portion comprising a nonwoven sheet joined to the nonwoven sheet of the other said construction portion and a respective layer of tow fibers joined to that nonwoven sheet and facing outwardly therefrom, one said construction portion having a greater longitudinal dimension than the other said construction portion to provide a longitudinally longer construction portion and a longitudinally shorter construction portion; and an attachment system for removably attaching said duster to a handle, said attachment system being disposed between said outwardly facing surfaces of said construction portions, said attachment system having a first portion disposed between said layers and a second portion disposed external to said layers, both said portions of said attachment system accessible by and removably attachable to a complementary handle, wherein said attachment system comprises an elongate sleeve suitable for receiving a tine from the handle, said elongate sleeve having a proximal end disposed externally to at least one of said layers and a distal end longitudinally remote therefrom said distal end being disposed between said layers.

9. A duster according to claim 8 wherein said each said construction portion has two ends as taken in the longitudinal direction, wherein said ends of said longitudinally shorter construction portion are offset from the respective ends of said longitudinally longer construction portion, to provide for entry of a handle into either end of said sleeve.

10. A duster according to claim 8 wherein said duster substantially comprises a first color and said externally disposed portion of said sleeve has a second color which contrasts with said first color.

11. A duster for removing debris from a surface, said duster comprising: a plurality of layers joined together to form a laminate, said laminate comprising two longitudinally elongate outwardly facing layers, each said outwardly facing layer comprising tow fibers, a nonwoven sheet or a combination thereof, each of said outwardly facing layers having a respective first end and a respective second end spaced apart therefrom in the longitudinal direction and being of substantially identical longitudinal dimension, said first ends of said two outwardly facing layers being spaced apart in the longitudinal direction, at least one central layer disposed between said outwardly facing layers; and an attachment system juxtaposed with said at least one central layer, said attachment system having a first portion disposed between said outwardly facing layers and a second portion facing outwardly from an exposed portion of said central layer, whereby said second portion of said attachment system can receive a handle complementary thereto.

12. A duster according to claim 11 wherein said attachment system comprises a sleeve for receiving a complementary tine associated with a handle, said sleeve being disposed on said central layer.

13. A duster according to claim 12 where said sleeve is longitudinally oriented and comprises plural bonds defining an opening therebetween.

14. A duster according to claim 13 wherein said plural bonds are mutually discrete.

15. A duster according to claim 14 further comprising plural central layers joined together to form a laminate between said outwardly facing layers.

16. A duster according to claim 12 wherein said sleeve has a proximal end to removably receive a handle and further comprising a visual indicium designating said proximal end of said sleeve.

17. A duster according to claim 16 wherein said layers are bonded together with a plurality of discrete bonds, and said discrete bonds form said visual indicium to designate the proximal end of said sleeve.

18. A duster according to claim 11 wherein said respective first ends of said two outwardly facing layers are spaced apart in the longitudinal direction and further wherein said respective second ends of said outwardly facing layers are spaced apart in the longitudinal direction.

19. A duster according to claim 11 wherein said first outwardly facing layer is shorter in the longitudinal direction than said second outwardly facing layer.

* * * * *